US009355525B2

(12) United States Patent
Mound

(10) Patent No.: US 9,355,525 B2
(45) Date of Patent: May 31, 2016

(54) METHOD AND SYSTEM TO FUND AND CONDUCT SECOND CHANCE GAMES

(71) Applicant: Scientific Games International, Inc., Newark, DE (US)

(72) Inventor: Andrew Jonathan Mound, Atlanta, GA (US)

(73) Assignee: Scientific Games International, Inc., Newark, DE (US)

( * ) Notice: Subject to any disclaimer, the term of this patent is extended or adjusted under 35 U.S.C. 154(b) by 99 days.

(21) Appl. No.: 14/260,436

(22) Filed: Apr. 24, 2014

(65) Prior Publication Data

US 2015/0310696 A1 Oct. 29, 2015

(51) Int. Cl.
*G07C 15/00* (2006.01)
*G07F 17/32* (2006.01)

(52) U.S. Cl.
CPC ..... *G07F 17/329* (2013.01); *G07F 17/32* (2013.01); *G07F 17/3258* (2013.01); *G07F 17/3267* (2013.01)

(58) Field of Classification Search
CPC ..... A63F 3/06; A63F 3/0605; A63F 3/08; G07F 17/32; G07F 17/3255; G07F 17/329
USPC ..... 463/16, 17
See application file for complete search history.

(56) References Cited

U.S. PATENT DOCUMENTS

| | | | | |
|---|---|---|---|---|
| 8,100,749 | B2 | 1/2012 | Walker et al. | |
| 8,512,123 | B2 | 8/2013 | Stanek et al. | |
| 8,517,811 | B2 | 8/2013 | Pollard et al. | |
| 2004/0176158 | A1 * | 9/2004 | Baldwin | G07F 17/32 463/17 |
| 2008/0045299 | A1 * | 2/2008 | Bennett | G06F 21/64 463/17 |
| 2009/0186680 | A1 * | 7/2009 | Napolitano | G07F 17/32 463/17 |
| 2011/0081958 | A1 * | 4/2011 | Herrmann | G07F 17/32 463/16 |
| 2012/0122538 | A1 * | 5/2012 | Pollard | G07F 17/329 463/17 |
| 2013/0178269 | A1 * | 7/2013 | Shaw | G07F 17/3244 463/16 |
| 2013/0237304 | A1 | 9/2013 | Oakes et al. | |

FOREIGN PATENT DOCUMENTS

| | | |
|---|---|---|
| WO | WO 02/094400 | 11/2002 |
| WO | WO 2005/101335 | 10/2005 |

OTHER PUBLICATIONS

PCT Search Report, Aug. 5, 2015.

* cited by examiner

*Primary Examiner* — Allen Chan
(74) *Attorney, Agent, or Firm* — Dority & Manning, P.A.

(57) ABSTRACT

A lottery second chance game program method is provided for a single lottery jurisdiction or across multiple participating lottery jurisdictions. The lottery jurisdictions are networked to a lottery server system. One or more production runs of primary game tickets are provide to each lottery jurisdiction, with each production run of game tickets having a total face value. For each of the production runs of game tickets, a percentage of the total face value is contributed by the lottery jurisdiction to fund prize awards in a plurality of second chance games that are common to all of the lottery jurisdictions. The plurality of second chance games are provided to all eligible players in all of the lottery jurisdictions by entry of a unique identifier from one or more losing primary game tickets into a central server system. The lottery jurisdictions thus fund the plurality of second chance games as a function of the total face value of game ticket production runs sold to players within their respective jurisdiction.

15 Claims, 4 Drawing Sheets

METHOD AND SYSTEM TO FUND AND CONDUCT SECOND CHANCE GAMES

FIELD OF THE INVENTION

The present invention relates to funding and conduct of second chance game events associated with separate and independent primary games in a single jurisdiction as well as across multiple jurisdictions.

BACKGROUND

Lottery games have become a time honored method of raising revenue for state and federal governments the world over. Traditional scratch-off and draw games have evolved over decades, supplying increasing revenue year after year. However, after decades of growth, the sales curves associated with traditional games seem to be flattening out. Consequently, both lotteries and their service providers are presently searching for new methods of increasing sales.

In one attempt to increase sales, United States lotteries have adopted second chance games where the consumer can enter losing lottery ticket codes on lottery Internet sites to play instant second chance games or to enter second chance drawings. However, for the most part, second chance games usually involve prizes of a minor nature compared to the main lottery games. Thus by their nature, second chance drawings are a minor part of overall game designs, are not a principal motivator for ticket purchases, and although they have their place, conventional second chance games have limited potential for assisting in the mainstream of lottery sales via the Internet or otherwise.

For the most part, second chance games have been limited to conduct within a single jurisdiction (i.e., a single state or other governmental entity under common jurisdictional laws) and dependent from a single primary game. For example, players within the state of Georgia, USA, may play "Lucky Seven" instant scratch-off tickets offered within Georgia, wherein players can enter a code from losing tickets into a second chance drawing designed specifically for the Lucky Seven game.

Scenarios have been implemented to expand ("link") second chance games to multiple jurisdictions. For example, MDI Entertainment, LLC, (a subsidiary of Scientific Games Corporation) offers a linked second chance game known as "Las Vegas Game Show Experience" to multiple states in the US. Lotteries participating in the program have the option to launch one or more primary instant games featuring logos and imagery from popular TV game shows. The lotteries are granted access (for their players) to a second chance website (the "Game show Gallery") that features a number of interactive second chance games based on the game show themes of the primary game tickets. Players from the respective states enter non-winning instant tickets into the Game Show Gallery and can choose any one of the games to play. For example, players from Kentucky, Virginia, and Maryland may all enter the same second chance game (e.g., The Price is Right® drawing). Winners are periodically drawn for each of the themed second chance drawings, with the winners winning a trip to Las Vegas where they may become eligible to win an additional bonus jackpot drawing. The trips are funded by each participating state purchasing the same number of trips. In a second chance game cycle wherein, for example, 200 winners are drawn, there may be 10 winners from Kentucky, 3 from Virginia, etc.

"Monopoly® Jackpot" is another second chance game offered by MDI Entertainment having a multi-jurisdictional component. Participating states offer Monopoly® instant lottery tickets to their residents. Non-winning players enter an identifier code from the non-winning tickets at a website where they are then able to play Monopoly®-themed second chance games. A component of the second chance program includes a multi-state progressive monthly jackpot drawing that grows based on cumulative Monopoly® instant ticket sales in all participating states.

Although quite successful, the second chance games discussed above may be improved upon to provide far more flexibility to the lotteries. With the current second chance game scenarios (within single jurisdiction or across multiple jurisdictions), second chance pool (funding) problems arise if a participating lottery desires to add or delete primary games from the second chance games, particularly if an added game has a different face value than other games in the program. Additional tickets added to the pool also raise questions about undesirably extending the second chance drawing schedule. The current second chance games do not give players an opportunity to pick and choose between games having different payouts, for example lower payouts that are drawn more frequently, or larger payouts that drawn less frequently, while remaining in the same second chance pool.

Thus, it is highly desirable to develop a new second chance game program that provides a high degree of flexibility to a single lottery jurisdiction, as well as to multiple jurisdictions participating in a common second chance program, particularly when it pertains to adding or deleting games in the second chance funding pool.

SUMMARY OF THE INVENTION

Objects and advantages of the invention will be set forth in part in the following description, or may be obvious from the description, or may be learned through practice of the invention.

In accordance with aspects of the invention, a computer-implemented method is provided for implementing and funding a lottery second chance game program. The method is easily adapted to Internet games, networked games, lottery games, and so forth In one embodiment, the second chance game program is implemented within a single lottery jurisdiction, for example within a single state within the United States. In an alternate embodiment, the second chance program is implemented across multiple lottery jurisdictions, for example multiple states within the United States that conduct separate and independent primary lottery games, but participate in a common second chance program in accordance with aspects of the present invention. In this regard, the term "multi-jurisdictional" is used herein to encompass separate jurisdictional entities, such as separate states within the United States, separate countries that cooperate in a common lottery game, and generally any combination of entities that govern the lottery gaming rules and regulations within their respective borders.

Although aspects of the present invention are explained herein with reference to particular lottery embodiments, it should be appreciated that the invention is not limited to lottery-type of primary games, but has usefulness and utility in any type of game or contest environment wherein a second chance opportunity is offered to players in the primary game.

For the single jurisdiction lottery embodiment, the method includes networking a lottery jurisdiction to a central lottery server system. For the multiple-jurisdiction embodiment, a plurality of lottery jurisdictions are networked to the central lottery server system. This system may be maintained by a lottery jurisdiction, or by a third party, such as a lottery service provider, that contracts with the respective lottery jurisdictions to provide lottery products and services. In each participating lottery jurisdiction, one or more production runs of game tickets are provided for use in at least one primary lottery game within the respective jurisdiction. In one embodiment, the primary lottery games are instant win scratch-off games and the production runs of game tickets are runs of instant win scratch-off game tickets, as compared, for example, to production runs of raffle tickets or draw tickets. Each production run of game tickets has a total face value that is computed as a function of the number of tickets within the run and the purchase price of each ticket. Each game ticket within a production run has unique identifier thereon, such as a barcode, serial number, or the like.

At this point, it is important to appreciate that the present method is not limited to any particular type of primary game, and that the rules and regulations of game play for any particular game are not relevant to the invention. The present method relates to funding and structuring a plurality of second chance games across both single as well as multiple jurisdictions, regardless of the type of primary game(s) offered in the single or multiple lottery jurisdictions.

For each of the production runs of game tickets, a defined percentage of the total face value is earmarked to fund a plurality of second chance games that are offered to players in the single or multiple lottery jurisdictions. Thus, in the multiple jurisdiction embodiment, the plurality of second chance games are common to all of the jurisdictions. The concept and attractiveness of "second chance games" is well-known to those skilled in the art and the consuming public, and relates to consolation games offered to players that lose in the primary lottery game.

Continuing with the present method, the plurality of second chance games are offered to all players in a single or multiple participating lottery jurisdictions by entry of the unique identifier from losing game tickets into the central server system. This may be accomplished in various ways. The identifiers may be automatically entered into the program immediately upon purchase of the game ticket in the primary game, wherein the win/loss status of the ticket is predetermined and known to the lottery server. In another embodiment, the second chance games are optional. For example, an Internet website may be maintained for the players, wherein the players log on and the enter the unique game ticket identifiers using any manner of Intent-enabled device, such as a smart phone, mobile device, personal computer, and so forth. The website may be maintained by any one or combination of the lottery jurisdictions, or third party lottery service provider.

The total amount contributed from the single or multiple lottery jurisdictions based on a percentage of the total face value for the game tickets sold within their jurisdiction is used to fund various prize awards of all of the second chance games, such as instant cash award games, jackpot drawing games, and so forth. It should be appreciated that the invention is not limited to any particular type of second chance game, or payout scenarios. Thus, the participating lottery jurisdiction(s) funds the plurality of second chance games as a function of the total face value of participating game ticket production runs sold to players within their respective jurisdiction. The lottery provider can select which ticket runs participate in the second chance game program.

In certain embodiments, the primary lottery games conducted in the different lottery jurisdictions have different total face values. For example, one state may offer a first game having a total face value of $250 million and a second game having a total face value of $50 million. A different state may offer a first game having a total face value of $10 million and a second game having a total face value of $1.25 million. In an alternate embodiment, all of the primary games within one lottery jurisdiction will have the same total face value. In still another embodiment, the primary lottery games conducted in the different lottery jurisdictions may all have the same total face value.

In a particular embodiment, each of the second chance games is a jackpot draw game having an initial jackpot reset value funded by the total amount contributed by the lottery jurisdictions. The draw games may be conducted according to any manner of well-known lottery draw games (e.g., Powerball™, and the like) wherein players select a set of play indicia from a field of indicia (or such play indicia is randomly generated for the players). For example, the players may select 5 numbers from the field of numbers 1 through 59. Game indicia are then randomly drawn from the field of indicia and wins are based on the number of matches between the players' play indicia and the drawn game indicia.

The second chance games may further include an additional instant cash award component. The jackpot draw games may be a progressive jackpot game where the prize award grows beyond an initial reset value as a function of the number of players that enter any one of the second chance games in any one of the lottery jurisdictions by entering the unique identifier from a losing game ticket. With a particular embodiment, for each game ticket entered into the second chance games, the lottery jurisdiction in which the game ticket was entered may be obligated to contribute an amount to fund the progressive component of the jackpot draw game. This amount may be a percentage of the face value for each entered losing ticket such that the lottery jurisdictions fund the progressive component as a function of the number of players that actually enter the second chance games within their lottery jurisdiction and face value of the entered tickets.

In one embodiment, the plurality of second chance games are equally funded from the total amounts contributed from the single or multiple lottery jurisdictions. In other words, the total amount is split equally between the various second chance games, wherein each second chance game then allocates the funds according to the prize structure/frequency of the respective game. For example, the plurality of second chance games may include periodic jackpot draw games, wherein the draw games having a greater frequency of play have lesser prize awards as compared to draw games having a lesser frequency of play. The prize awards and frequency of play are established so as to distribute the equally funded amounts allocated to each of the second chance games over a defined cycle time of the second chance games. The cycle time is variable and may be, for example, one year, wherein one of the second chance drawing games is conducted twice per year and another one of the drawing games is conducted four times in the same year. A participating lottery may decide, for example, that it desires the program to be in circulation for thirteen months, during which the lottery may have daily, weekly, monthly, etc., drawings. The number of future drawings are determined when the jackpot resets are calculated.

In certain embodiments, the players in the second chance game program are issued entries into the second chance games or exchangeable credits for future play in the second chance games for each ticket identifier entered from a losing game ticket, wherein the number of credits is a function of the purchase price of the losing primary game ticket. For example, the players may be issued three credits for every $1 of primary game ticket face value. This value may generally be determined based upon a distribution of entries. For example, if the distribution of entries is [1, 2, 3, 4, 5], then the average entries/$1 FV is 3, which is multiplied by $FV. Thus, a $5 distribution will payout an average of 15 entries. In addition, the number of entries or credits needed to enter any particular second chance games may be a function of the prize award or frequency of play of the particular second chance game. A game having one or two drawings per cycle year with relatively large jackpot amounts may require more credits per game than a game drawn weekly. The players may store accumulated credits in an on-line account established with the lottery central server, the account accessible to the player via the same website used to enter the losing ticket identifiers.

In an alternate embodiment, funding of the second chance lottery games from the total amounts contributed from the single or multiple lottery jurisdictions is weighted (i.e., not split equally between the games) such that certain of the second chance games receive more funding than other ones of the second chance games. The number of credits needed to play the games may also be weighted within the cycle time. In other words, the second chance games receiving more funding (and awarding more prizes) per cycle require a greater number of credits than the second chance games receiving less funding (and lesser prize awards) over the same defined cycle time.

The type of primary lottery games may vary. For example, in certain embodiments, the primary games are instant win scratch-off games, wherein the production runs of game tickets are runs of instant win scratch-off lottery tickets. The same instant games may be provided to all of the lottery jurisdictions, or the lottery jurisdictions may play different respective games. The different instant games may have the same or different total face values.

It should be appreciated that players in the second chance game program may be provided the option to pick and choose which of the second chance games they would like to enter from all of the participating games. For example, if the second chance game program is conducted within a single jurisdiction and has 5 different second chance games, a player within that jurisdiction may select any one or more of the second chance games in which to enter, regardless of the primary game played by the player to gain entry into the second chance game program. In the same light, if the second chance game program is conducted across multiple jurisdictions, and each jurisdiction sponsors 3 different second chance games, a player in any one of the jurisdictions may select any one or more of the games from the totality of different jurisdiction games, regardless of the primary game played by the player in their respective jurisdiction.

DETAILED DESCRIPTION

Figure 1:
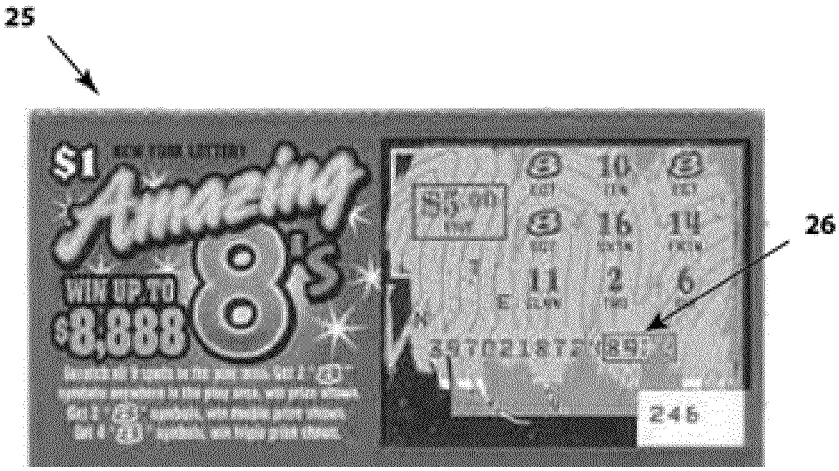
FIG. 1 is an illustration of a generic instant win scratch-off lottery ticket.

Reference will now be made in detail to embodiments of the inventive methods and systems, one or more examples of which are illustrated in the drawings. Each embodiment is presented by way of explanation of the invention, and not as a limitation of the invention. For example, features illustrated or described as part of one embodiment may be used with another embodiment to yield still a further embodiment. It is intended that the present invention include these and other modifications and variations as come within the scope and spirit of the invention.

In general, the present disclosure is directed to systems and methods for conducting a computer-implemented method for establishing a lottery second chance game program within a single lottery jurisdiction or across multiple lottery jurisdictions. For sake of completeness, the following discussion is drawn primarily to embodiments conducted across multiple jurisdictions. It should be appreciated, however, that the system and method are just as applicable to a second chance game program within a single jurisdiction.

Figure 2:
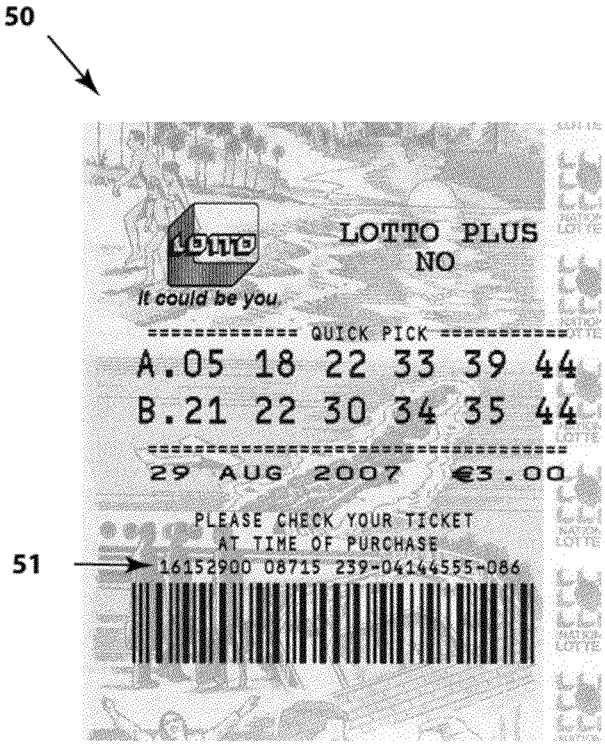
FIG. 2 is an illustration of a generic on-line lottery draw ticket.

As their name implies, second chance games or drawings are a method for a consumer to win a prize with an apparent losing ticket from an initial or primary lottery game. Traditionally, these second chance tickets can be from losing instant (scratch-off) game tickets. FIG. 1 illustrates a generic scratch-off lottery ticket 25 having a unique serial or validation number 26 printed thereon. The other printed indicia on the ticket of FIG. 1 is not relevant to an understanding of generic scratch-off tickets. Likewise, FIG. 2 illustrates a generic lottery draw game ticket 50 with a unique serial number 51 printed thereon. Typically, the consumer enters the unique serial or validation number 26, 51 provided on the purchased ticket 25, 50 on a website hosted by the lottery or lottery service provider (or other method, e.g., mobile, mail-in drawing, etc.) to enter the second chance drawing associated with the losing ticket. The present invention also encompasses second chance game programs wherein the player is automatically entered into the program in the event of a losing play or other condition in a primary game.

It should also be appreciated that the present method and system embodiments are not limited to any particular type of primary lottery game ticket or entry means by which players register a losing game ticket into a second chance game program, and that the tickets 25, 50 of FIGS. 1 and 2 are for illustrative purposes only.

With conventional second chance game programs, the prizes for such games are generally funded from a portion of the sales of the lottery tickets within a single respective lottery jurisdiction. For example, in a typical instant ticket game, the prize fund (i.e., the percentage of the purchase price of the ticket that is devoted to prizes) is usually around 65%, with the remaining 35% funding the lottery as well as the production, distribution, validation, and other logistical functions associated with the instant ticket game. In a typical draw game, the prize fund is usually around 50%, with the remainder again being devoted to lottery profit and the logistics of creating the draw game itself. Thus, the funds reserved for the second chance games typically either come from the winning prize fund or the remainder. Funding the second chance games from the prize fund has the disadvantage of depleting the value of apparent winnings from a consumer's perspective and, conversely, funding from the remainder has the disadvantage of either depleting the funds available for the lottery or the game logistics. Therefore, with conventional games, funds reserved for second chance games typically are a small percentage of the purchase price (e.g., 1% to 2%) for a single game within a single lottery jurisdiction, and consequently have little impact on sales of the primary game tickets. The method and system of the present invention are not so limited.

Embodiments of the methods disclosed herein may be executed by one or more suitable networked lottery gaming systems. Such system(s) may comprise one or more computing devices adapted to perform one or more embodiments of the methods disclosed herein. As noted above, such gaming systems and computing devices may access one or more computer-readable media that embody computer-readable instructions which, when executed by at least one computer, cause the computer(s) to implement one or more embodiments of the methods of the present subject matter. Additionally or alternatively, the computing device(s) may comprise circuitry that renders the device(s) operative to implement one or more of the methods of the present subject matter. Furthermore, components of the presently-disclosed technology may be implemented using one or more computer-readable media.

Any suitable computer-readable medium or media may be used to implement or practice the presently-disclosed subject matter, including, but not limited to, diskettes, drives, and other magnetic-based storage media, optical storage media, including disks (including CD-ROMS, DVD-ROMS, and variants thereof), flash, RAM, ROM, and other memory devices, and the like.

The present disclosure also makes reference to the transmission of communicated data over one or more communications networks. It should be appreciated that network communications can comprise sending and/or receiving information over one or more networks of various forms. For example, a network can comprise a dial-in network, a local area network (LAN), wide area network (WAN), public switched telephone network (PSTN), the Internet, intranet or other type(s) of networks. A network may comprise any number and/or combination of hard-wired, wireless, or other communication links.

Figure 3:
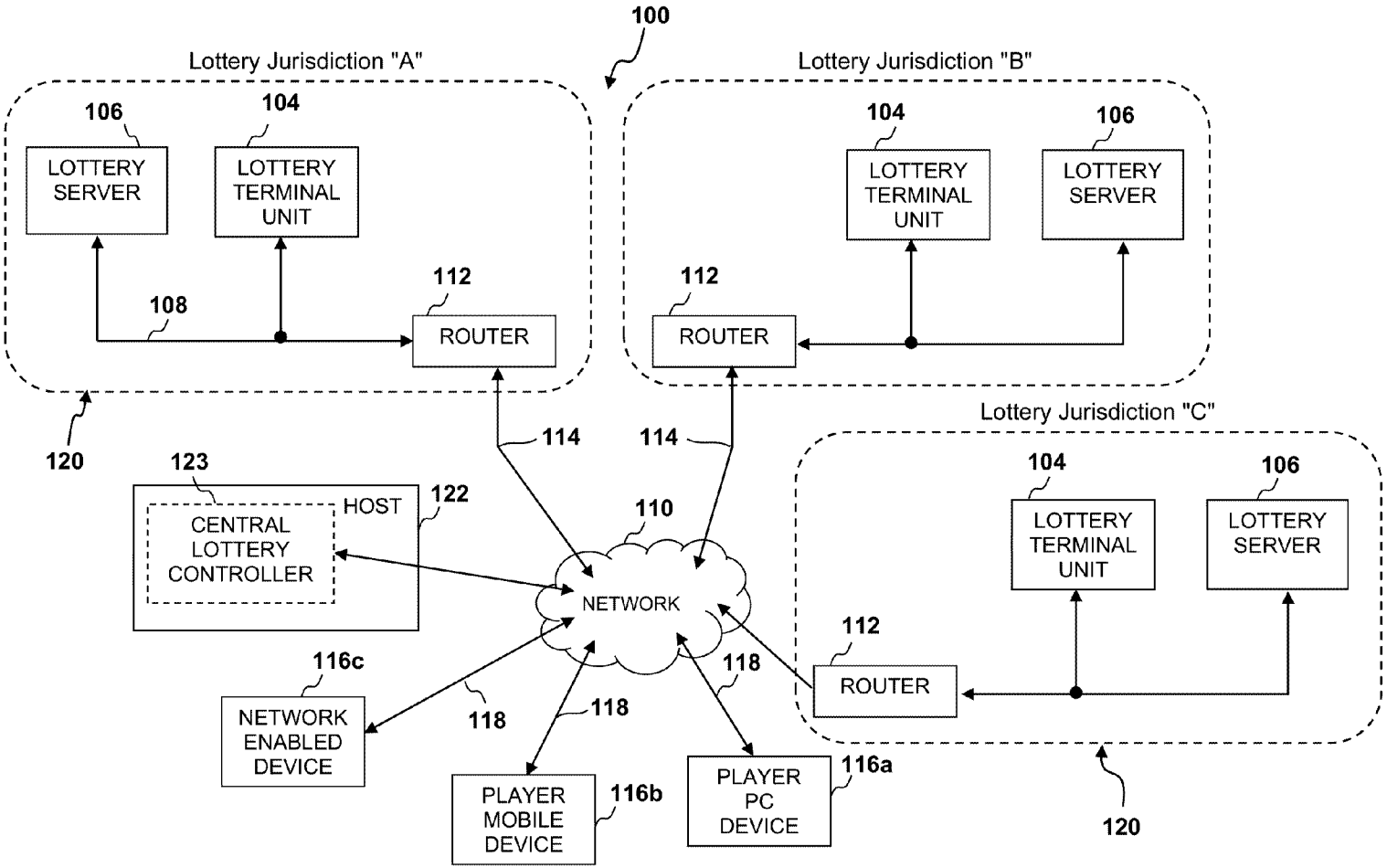
FIG. 3 is a schematic view of an exemplary gaming system that may be used to implement various method embodiments in accordance with aspects of the present invention.

FIG. 3 is a diagram view of a representative gaming system 100 that may be used to practice aspects of the second chance game program in accordance with a multiple-jurisdiction embodiment of the invention. The exemplary system 100 includes a central system 122 with a central controller 123 administered by a game provider that contracts with the respective lottery jurisdictions "A", "B", and "C" to provide lottery products and services. In an alternate embodiment, the central system 122 may be maintained by any one or combination of the lottery jurisdictions or lottery service provider. It should be readily appreciated that the central controller 123 may include an integrated server, or the host central system 122 may include any manner of periphery server or other hardware structure. The host computer system 122 is configured to carry out the funding functions (and other related gaming functions) associated with the second chance game program described herein.

As discussed above, the depicted system and method are for implementing the second chance game program to a plurality of different lottery jurisdictions (i.e., "multi-jurisdictional"), as represented by the separate lottery jurisdictions A through C in FIG. 3. The term "jurisdiction" is intended to encompass separate jurisdictional entities, such as separate states within the United States, separate countries that cooperate in a common lottery game, and generally any entity that governs the lottery gaming rules and regulations within its respective borders. In each of the plurality of lottery jurisdictions, one or more production runs of game tickets 25, 50 (FIGS. 1 and 2) are provided for use in at least one primary lottery game within the respective jurisdiction. "Multi-jurisdictional" also encompasses multiple sets of multi-party jurisdictions. For example, the system may serve a first multi-party of California and Georgia, a second multi-party of Texas and Minnesota, a third multi-party of Rhode Island and Delaware, and so forth.

The host central computer system 122 may be a single networked computer, or a series of interconnected computers having access to the network 110 via a gateway or other known networking system. Generally, the central controller 123 configured to communicate with, manage, execute and control individual terminal units 104 (described in greater detail below) within each lottery jurisdiction, and to interface with the network enabled devices 116 of the players in all of the jurisdictions for entry into and play of the second chance games, as described herein. The central controller 123 may include a memory for storing gaming procedures and routines, a microprocessor (MP) for executing the stored programs, a random access memory (RAM) and an input/output (I/O) bus. These devices may be multiplexed together via a common bus, or may each be directly connected via dedicated communications lines, depending on the needs of the system 100.

The central controller 123 may be directly or indirectly connected through the I/O bus to any manner of peripheral devices such as storage devices, wireless adaptors, printers, and the like. In addition, a database (DB) may be communicatively connected to the central controller 123 and provide a data repository for the storage and correlation of information gathered from the individual terminal units 104 or devices 116. The information stored within the database may be information relating to individual players, games, or game card specific information.

Aspects of present system and method call for the players in a single or multiple participating lottery jurisdictions to interface with the host central computer system 122. This may be done directly, as illustrated in FIG. 3, or indirectly via the individual lottery jurisdiction servers 106. For example, the players may be provided with a website address printed on the primary game ticket, whereby the player enters their losing game ticket into the second chance game program by accessing the central computer system 122 directly via a network enabled device 116*c* (for example, an Internet enabled PC 116*a*, or smart phone/mobile device 116*b*). Depending on the requirements of how the second chance games are actually conducted, the player may be directed to download gaming software to their PC or other network-enabled device that enables the player to perform all functions needed to participate in the second chance games. The network enabled devices 116 may be directly connected to the network 110 through a plurality of direct network links 118, thereby eliminating the need for the bus, router, or other networking equipment. The devices 116 are configured to execute one or more computer programs, such as an Internet browser program, to allow users to interact with the central computer system 122, and preferably include a visual display such as a monitor or screen. Alternatively, the visual display may be incorporated into a web-browser configured to display multimedia content. For instance, a player may access the system 122 remotely via an Internet web-browser on player device 116.

In one embodiment, the player's network enabled device may be located at a point of sale location for the primary lottery tickets, and may even be a part of the terminals 104. In this embodiment, a player may interact with the system 122 immediately after purchasing or receiving a primary game ticket.

Each lottery jurisdiction in FIG. 3 may be differently configured for purposes of carrying out various lottery functions within its borders. For purposes of discussion, each lottery jurisdiction may be considered as a node. The lottery jurisdiction nodes 120, in turn, may be directly connected and/or multiplexed to the network 110 via direct network links. Further, the direct network links may be secure communications channels physically hardened against tampering and/or the communications may be encrypted to prevent unauthorized access to information transmitted thereon.

With each lottery jurisdiction, a plurality of terminal units 104 may be provided at multiple locations and connected with a LAN or WAN. Further, the LAN and/or WAN connecting each of the terminal units 104 may include one or more separate and secure buses 108, routers 112, web servers 106, gateways and other networking equipment to provide continuous and/or redundant connectivity to the network 110. As discussed above, the network 110 may be communicatively connected to central host computers 122 and/or respective central controllers as well as associated databases to allow for implementation, storage, tracking and analysis of gaming and other features. The network 110 may also be connected to external systems (e.g., Facebook™' Twitter™, etc.) for different purposes. For example, the players may be notified through these external systems as to whether or not they won or lost in the primary or second chance games.

A social network aspect may also be incorporated into the second chance game program wherein eligible second chance players meet via an external system (e.g., Facebook, Twitter) or internal lottery social network and "team-up" to pool entries or credits for play of certain second chance games, with any prize awards being distributed to the team players as a function of their credit contribution.

The terminal units 104 may be configured with any manner of hardware and software functionality to accept a player's entry and wager into a primary game, such as an on-line game or purchase of an instant game ticket. The terminal units 104 may also be configured for redeeming a player's game ticket after completion of the primary game, or completion of the second chance game of the player's choice. For example, the terminals may issue a credit slip that the player uses to collect their prize award at an establishment's cashier or an authorized lottery redemption center.

The terminals 104 may include any conventional feature known to those skilled in the art related to lottery terminals. The terminal 14 includes features and functionality to allow a player or retail clerk to enter the information required to participate in the lottery game. An exemplary terminal 14 includes a housing, one or more input devices, which may be a control panel having input keys, a display, a value input device such as a card reader, a play slip or ticket reader, and a ticket printer. The play slip reader is typically configured to read user selection marks, bar codes, magnetically stored information, or any other desired input information. Control panel input keys allow the player or retail clerk to select the game to be played, input the value to be wagered, manually enter selected lottery characters, and input any other information necessary to play the lottery game. The terminal may include a display which may be an LCD, a CRT, or touch-screen capable of receiving and displaying information related to the game. The value input device may include any device that can accept value or a wager from a customer, such as a card reader or an optical currency collector. The value input device may be integrated with external devices, such as a cash register or other retail terminals, to exchange information necessary to receive and record the wagering transaction. The game ticket printer may be used to print or otherwise encode game tickets with information selected or required to play the lottery game. The printer may provide game tickets that reflect a player's selection, or complete lottery slips if the selection was generated automatically by the terminal. It should be readily appreciated that particular embodiments of terminals 14 are not meant as a limitation of the invention, and that embodiments of the present invention may encompass any configuration of features and functionality to allow initiation and playing of a lottery game.

Figure 4:
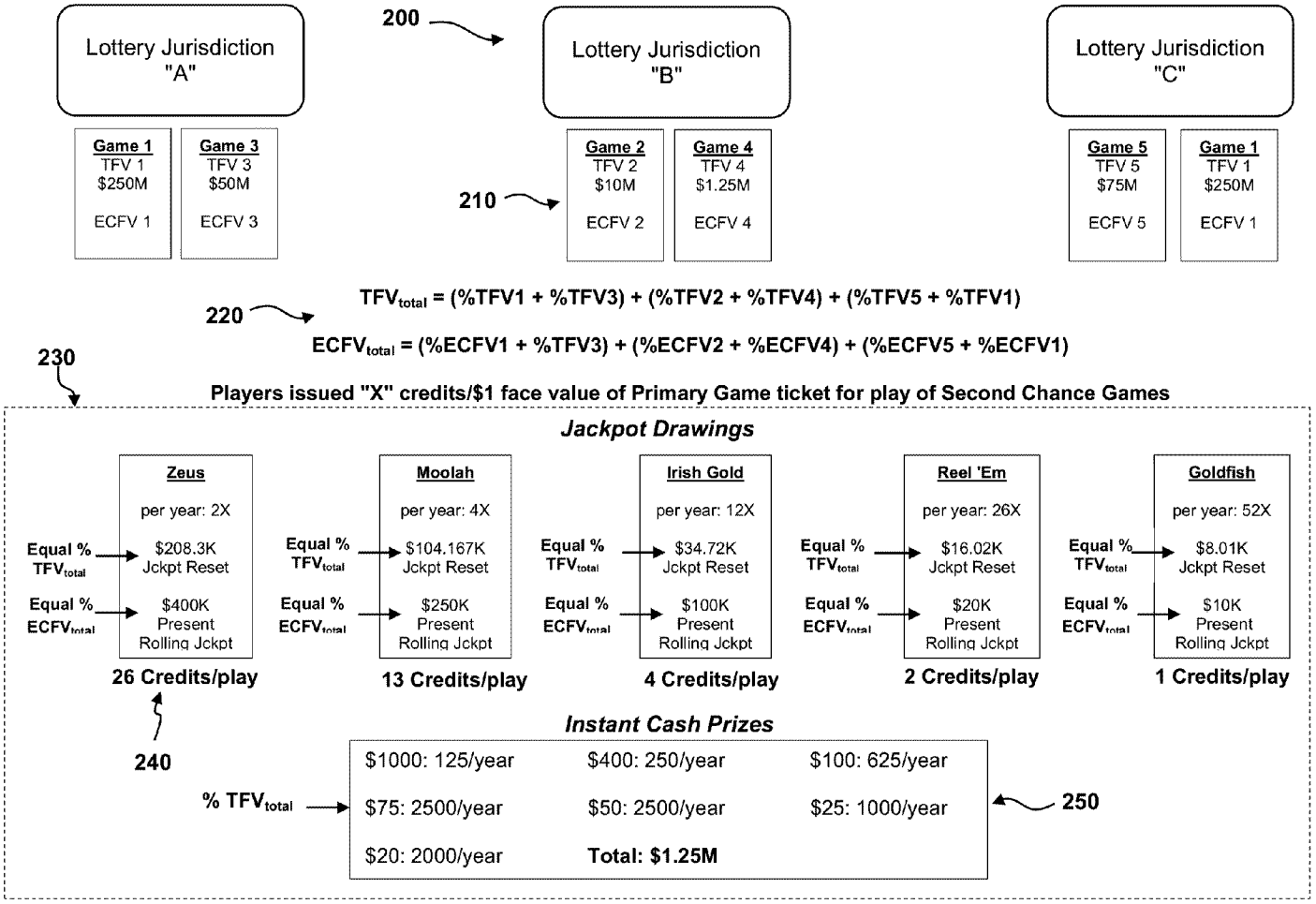
FIG. 4 is a block diagram view representing aspects of a second chance game funding method in accordance with aspects of the present invention.

Aspects of the funding method or second chance games in accordance with the invention are discussed with respect to the non-limiting embodiment of FIG. 4. Section 200 depicts a plurality of separate lottery jurisdictions A, B, and C, which may be individual states within the United States, or states within the United States and provinces in Canada, and so forth. As discussed above, these lottery jurisdictions are networked with a central lottery server system. Each of the lottery jurisdictions in the illustrated example provides two primary lottery games (section 210 of FIG. 4), although this number is for illustrative purposes only. The only requirement is that a participating lottery jurisdiction A, B, and C provides at least one primary game to players. The lottery jurisdictions are offered five different primary games. Lottery Jurisdiction A provides Games 1 and 3 to its players; Lottery Jurisdiction B provides Games 2 and 4 to its players; and Lottery Jurisdiction C provides Games 5 and 1 to its players. It should be appreciated that the different primary games may be completely unrelated and may have any desired theme, prize schedule, and so forth.

For each of the primary games 1 through 5, a production run of tickets is produced and provided to the respective lottery jurisdictions. In the case of instant win scratch-off tickets (FIG. 1), the actual tickets in the production run are delivered to the jurisdiction for distribution to authorized sales agents. In the case of on-line draw tickets (FIG. 2), the "production run" may be considered as an authorized number of tickets to be printed by terminals at authorized sales locations. For sake of simplicity, the present discussion will focus on the instant win scratch-off tickets. The production run of tickets may be provided to the lottery jurisdictions by the same lottery provider that maintain the central lottery computer system (FIG. 3) and associate website that is accessed by players for entry into the second chance game program, as discussed above.

A production run of tickets 25 (FIG. 1) includes a total number of tickets, with each ticket having face value (i.e., price of the ticket to the player). The Total Face Value (TFV) for a game is the number of tickets in the production run multiplied by the face value of each ticket. For example, referring to FIG. 4, Game 1 has a TFV of $250 M, which may correspond to a production run of 25 million tickets having a face value of $10/ticket. The various TFV's for Games 2 through 5 are provided in FIG. 4.

It should be appreciated that the primary lottery games conducted in the different lottery jurisdictions A through C may have different TFV values. For example, the primary lottery games in Lottery Jurisdiction A may all have the TFV of $100 M, while the games offered in Lottery Jurisdiction C may all have the TFV of $50 M. In an alternate embodiment, the primary lottery games conducted in the different lottery jurisdictions all have the same TFV. For example, all five primary games in the embodiment of FIG. 4 may have a TFV of $200 M. In still another embodiment as depicted in FIG. 4, each lottery jurisdiction provides a plurality of the primary lottery games to players in their respective jurisdiction, the plurality of primary lottery games having the same or different total face values. Again, it should be understood that a lottery jurisdiction can pick and choose which of the primary games if offers will participate in the second chance program.

A plurality of common second chance games (section 230) are provided by the lottery provider to all of the players in the single or multiple different participating lottery jurisdictions A through C. Referring to the embodiment of FIG. 4, five different second chance games are provided: Zeus, Moolah, Irish Gold, Reel'Em, and Gold Fish. The second chance games may have a theme that is completely unrelated to the primary games, or may "relate" to the five primary games by theme. For example, the instant win tickets of Game 3 may have an Irish Leprechaun theme and the Irish Gold second chance game may be an extension of (or otherwise relate to) the Irish Leprechaun theme. As discussed above, the players enter the unique serial number or code (26 in FIGS. 1 and 51 in FIG. 2) from a losing primary lottery game ticket to gain access to the second chance game program and the opportunity to select one or more of the offered second chance games. It should be appreciated that the players may select any one or combination of the offered second chance games, even if their selected game does not relate to the primary games offered in their respective lottery jurisdiction. For example, a player from Lottery Jurisdiction B may select the Irish Gold second chance game even though such game relates (at least by theme) to Game 3, which is not offered in Lottery Jurisdiction B.

To fund aspects of the second chance games, each lottery jurisdiction participating in the program contributes a defined percentage of the TFV for each production run of primary game tickets, regardless of the actual number of tickets in the production run that sold in the jurisdiction (section 220). For example, Lottery Jurisdiction A may be required to contribute 0.5% of the TFV for each of Games 1 and 3. Likewise, Lottery Jurisdiction B may be required to contribute 0.5% of the TFV for Games 2 and 4. Lottery Jurisdiction C may be required to contribute 0.5% of the TFV for Games 5 and 1. The Total TFV amount ($TFV_{total}$) is the combined total of the TFV's from each lottery jurisdiction and, in the embodiment of FIG. 4, is: $TFV_{total}$=(% TFV1+% TFV3) from jurisdiction A+(% TFV2+% TFV4) from jurisdiction B+(% TFV5+% TFV1) from jurisdiction C.

Funding of the second chance games with the $TFV_{total}$ will depend on the types of games being conducted. In the embodiment of FIG. 4, the second chance games are draw games having varying frequencies. For example, Zeus is a draw game drawn 2× per year; Moolah is a draw game drawn 4× per year; Irish Gold is a draw game drawn 12× per year; Reel 'Em is a draw game drawn 26× per year; and Goldfish is a draw game drawn 52× per year (e.g., once per week). In the embodiment of FIG. 4, the initial jackpot amounts ("jackpot resets") for each second chance game over a cycle time for the second chance game program are generally equally funded from the $TFV_{total}$. For example, assuming a cycle time of one year for all of the second chance games, each game is funded with generally $416.6K to be split equally between their jackpot drawings over the course of the year (e.g., Zeus has a jackpot reset of $208.3K for each of 2 drawings and Goldfish has a jackpot reset of $8.01 for each of 52 drawings).

Still referring to FIG. 4, the second chance game program may also include an instant cash prize component (section 250) wherein various cash prizes are awarded to randomly drawn eligible second chance players, wherein the pool of eligible players includes all of the second chance players from all of the lottery jurisdictions. For example, in the embodiment of FIG. 4, a defined percentage or amount of the $TFV_{total}$ (in this case, $1.25 M) may be allocated for funding the instant cash prize component.

In still a further embodiment of the second chance game program, the jackpot games may be progressive or rolling jackpot games wherein the prize awards grow from the initial jackpot reset amount. In the embodiment of FIG. 4, the jackpots grow as a function of the actual number of losing primary game tickets entered into the second chance program. In other words, for every losing primary game ticket entered into the program, the jackpot value for each of the five second chance jackpot games incrementally increases. To fund this progressive component of the jackpot games, each of the lottery jurisdictions contributes a defined percentage of the face value for each ticket entered from players in their respective jurisdictions (the "Entered Code Face Value (ECFV)"). The Total ECFV amount ($ECFV_{total}$) is the combined total of the ECFV's from each lottery jurisdiction and, in the embodiment of FIG. 4, is: $ECFV_{total}$=(% ECFV1+% ECFV3) from jurisdiction A+(% ECFV2+% ECFV4) from jurisdiction B+(% ECFV5+% ECFV1) from jurisdiction C. As with the jackpot reset funding in the embodiment of FIG. 4, the rolling jackpot components are equally funded such that each second chance game receives the same amount of funding over the cycle time for the second chance games.

Because of the varying frequency and different payouts of the second chance games, it is desirable for the entry requirements for each game to also vary accordingly. One means to accomplish this is to issue the second chance players "credits" to be used as entries to play the second chance games, wherein the number of credits required varies between the games (section 240). For example, in the embodiment depicted in FIG. 4, the second chance players are issued an average of "X" (e.g., "3") credits for every $1 dollar face value of losing primary game tickets entered into the program. In other words, if the players are issued 3 credits per $1 of face value, a player entering two $10 primary game tickets and five $2 primary game tickets is issued 30 credits. A website may be provided (and maintained by the central lottery provider) for the players to set up an account wherein their accumulated credits are stored. This website may be linked to the website accessed by the players for entry of a losing primary game ticket (or may be a tab within the same website). For play of the second chance games via an Internet enable device, as discussed above, the players can debit their account for the number of credits needed to play any one or combination of the second chance games at a time of the player's choosing.

Figure 5:
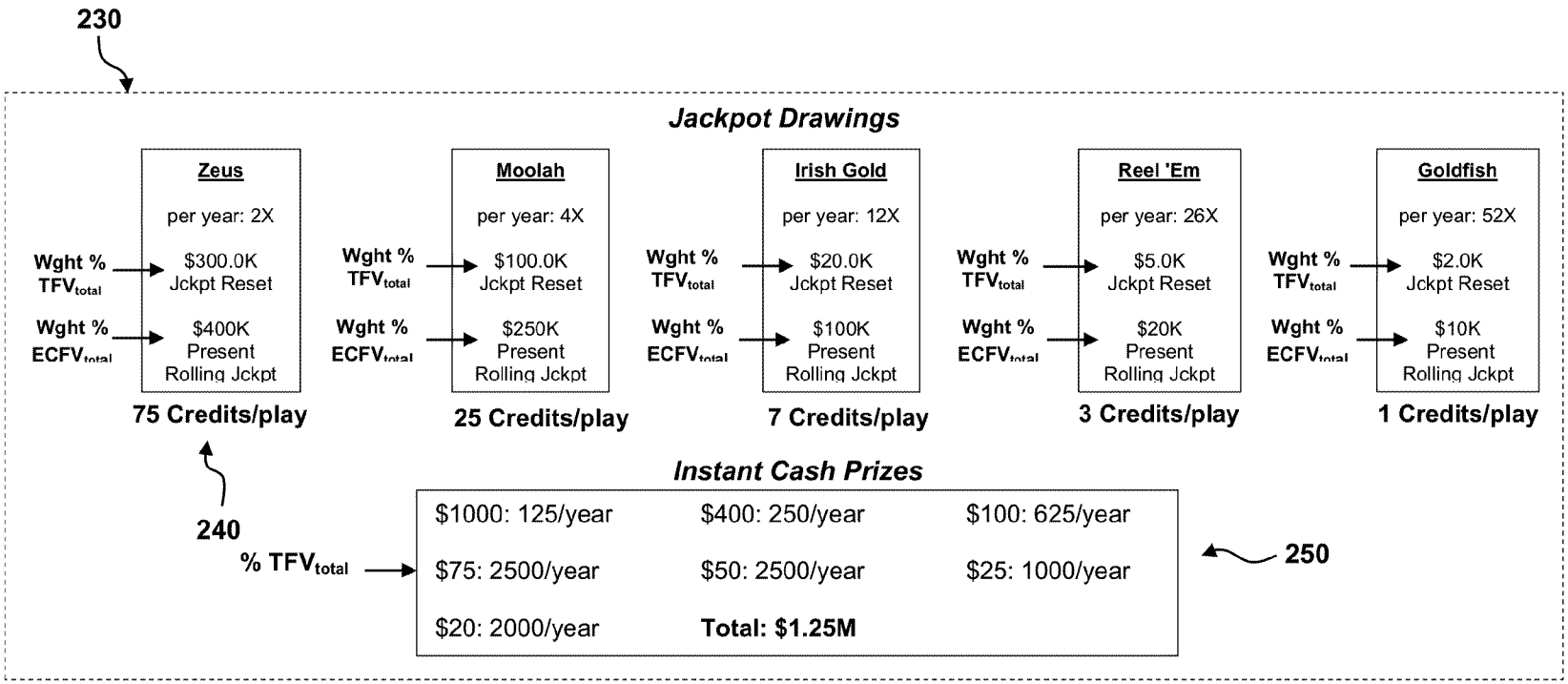
FIG. 5 is a block diagram view representing aspects of another embodiment of a second chance game funding method in accordance with aspects of the present invention

FIG. 5 depicts an alternate embodiment of the second chance game program. In this embodiment, funding of the second chance games from the $TFV_{total}$ is weighted such that certain of the second chance games receive more funding than other ones of the second chance games over the cycle time for the second chance game program. For example, the jackpot reset amount for Zeus over the cycle time is $600K (2 drawings at a reset of $300K/drawing). Moolah has a total reset amount of $400K over the cycle time. Goldfish has a total reset amount of $104 over the cycle time. If a rolling jackpot is also provided, funding of this component from the $ECFV_{total}$ may be also be weighted such that certain jackpots grow faster than others. Because of the weighted prize amounts the number of credits needed to enter a particular second chance game may also be weighted such that the second chance games receiving more funding require a greater number of credits than the second chance games receiving less funding over the defined cycle time of the second chance games. For example, Zeus has the most funding and requires 150 credits over the game cycle time, whereas Goldfish has the least funding and requires 52 credits over the cycle time.

It should be appreciated by those skilled in the art that various modifications and variations may be made present invention without departing from the scope and spirit of the invention. It is intended that the present invention include such modifications and variations as come within the scope of the appended claims.

What is claimed is:

1. A computer-implemented method for implementing a second chance game program, the method comprising:

networking a plurality of different and separate lottery jurisdictions to a common lottery server system;

for each lottery jurisdiction, producing a respective production run of game tickets for use in each of a plurality of primary lottery games within the respective jurisdiction, each production run of game tickets having a total face value, each game ticket within a production run having a unique identifier thereon;

for each of the production runs of game tickets, the lottery server system defining a percentage of the total face value to be contributed by each lottery jurisdiction to fund prize awards in a plurality of second chance games that are offered to players in all of the lottery jurisdictions;

funding the plurality of second chance games with the total face value percentage amount contributed from all of the lottery jurisdictions;

the common lottery serves implementing play of the plurality of second chance games to qualifying players in all of the lottery jurisdictions upon entry of the unique identifier from losing game tickets into the server system; and wherein each lottery jurisdiction thus funds the plurality of second chance games as a function of the total face value of game ticket production runs sold to players within their respective jurisdiction.

2. The method as in claim 1, wherein the primary lottery games conducted in the lottery jurisdictions have different total face values.

3. The method as in claim 1, wherein the primary lottery games conducted in the lottery jurisdictions have the same total face value.

4. The method as in claim 1, wherein each of the second chance games is a jackpot draw game having an initial jackpot reset value funded by the total amount contributed by the lottery jurisdictions.

5. The method as in claim 4, wherein each of the second chance games further includes an additional instant cash award component.

6. The method as in claim 4, wherein each of the jackpot draw games is a progressive jackpot game where the prize award grows as a function of the number of players that enter any one of the second chance games by entering the unique identifier from a losing game ticket.

7. The method as in claim 6, wherein for each game ticket entered into the second chance games, the lottery jurisdictions are obligated to contribute a defined amount to fund the progressive component of the jackpot draw game.

8. The method as in claim 7, wherein the defined amount is a percentage of the face value for each entered losing ticket such that the lottery jurisdiction funds the progressive component as a function of the number of players that actually enter the second chance games within the lottery jurisdiction and face value of the entered tickets.

9. The method as in claim 1, wherein the plurality of second chance games are equally funded from the total face value percentage amount contributed from the lottery jurisdictions.

10. The method as in claim 9, wherein the plurality of second chance games have varying prize awards and varying frequency of play, with the total prize awards over a defined cycle time for the second chance games being equal for each of the second chance games.

11. The method as in claim 10, wherein players are issued credits for each ticket identifier entered from a losing game ticket, the number of credits needed to enter a particular second chance game being a function of the prize award or frequency of play of the particular second chance game.

12. The method as in claim 1, wherein funding of the second chance games from the total face value percentage amount contributed from the lottery jurisdictions is weighted such that certain of the second chance games receive more funding than other ones of the second chance games.

13. The method as in claim 12, wherein players are issued credits for each ticket identifier entered from a losing game ticket, the number of credits needed to enter a particular second chance game being weighted such that the second chance games receiving more funding require a greater number of credits than the second chance games receiving less funding over a defined cycle time of the second chance games.

14. The method as in claim 1, wherein the primary lottery games are instant win scratch-off games and the production runs of game tickets are production runs of instant win scratch-off lottery tickets.

15. The method as in claim 1, wherein the central lottery server is maintained by a lottery provider that also provides the production runs of game tickets to the lottery jurisdiction.

* * * * *